United States Patent [19]

Dean et al.

[11] Patent Number: 4,597,733

[45] Date of Patent: Jul. 1, 1986

[54] GAS HEATING SYSTEM FOR DEHYDRATORS AND THE LIKE

[76] Inventors: Alvin Dean, Box 336, Bloomfield, N. Mex. 87413; Rodney T. Heath, 109 W. 31st St., Farmington, N. Mex. 87401

[21] Appl. No.: 701,753

[22] Filed: Feb. 14, 1985

[51] Int. Cl.[4] ..... F23Q 9/00

[52] U.S. Cl. ..... 431/285; 110/264; 431/278; 431/42

[58] Field of Search ..... 432/222, 219, 175; 431/278, 285, 42; 110/264, 262, 265

[56] References Cited

U.S. PATENT DOCUMENTS

| | | | |
|---|---|---|---|
| 1,364,972 | 1/1921 | Andersone et al. | 431/285 |
| 1,866,541 | 7/1932 | Branche et al. | 431/42 |
| 1,938,851 | 12/1933 | McKee | 431/285 |
| 2,457,378 | 12/1948 | Johnson et al. | 431/42 |
| 3,180,395 | 4/1965 | Reed | 431/285 |
| 3,198,239 | 8/1965 | Webster | 431/278 |
| 3,429,645 | 2/1969 | Reed | 431/285 |
| 3,897,200 | 7/1975 | Childree | 431/285 |
| 4,466,363 | 8/1984 | Leikert et al. | 110/264 |
| 4,479,442 | 10/1984 | Itse et al. | 110/264 |
| 4,490,106 | 12/1984 | Lazarre et al. | 431/278 |

*Primary Examiner*—Henry C. Yuen
*Attorney, Agent, or Firm*—Klaas & Law

[57] ABSTRACT

A gas heating system for a natural gas dehydration or the like comprising a burner housing means, a main gas burner unit and a pilot light gas burner unit mounted in the housing means, and separate air-gas supply means for each of the main gas burner unit and the pilot light gas burner unit.

7 Claims, 6 Drawing Figures

GAS HEATING SYSTEM FOR DEHYDRATORS AND THE LIKE

BACKGROUND & SUMMARY OF THE INVENTION

This invention relates to a gas heating system for a natural gas dehydrator and other kinds of oil and gas processing equipment.

In the production and processing of oil and gas, certain kinds of equipment such as gas dehydrators of the type disclosed in U.S. Pat. Nos. 3,094,574, 3,288,448 and 3,541,763 employ gas fired heating systems which utilize variable quality gas such as propane or natural gas available at the well head or processing site. The processing equipment is often situation at remote, relatively inaccessible locations and must be reliably continuously operable without attention by operating or maintenance personnel under variable and sometimes extreme climatic conditions.

Such gas heating systems comprise an elongated burner housing containing a main gas burner unit, which is operable intermittently on demand when heat is required, and a pilot light gas burner unit which provides a continuous flame to ignite the main burner unit. One of the problems with such burner systems has been pilot light flame-out.

A source of pressure change in the burner housing, which can cause pilot light flame-out, is a downdraft in the exhaust outlet stack from a combustion chamber which results in an insufficient supply of oxygen to support combustion. In the past, combustion air for both primary and secondary air for both the main burner and the pilot light burner has been supplied through one relatively large size combustion air inlet port at the end of the burner housing. An object of the present invention is to prevent pilot light flame-out caused by stack downdrafts by providing a separate combustion air inlet port for the pilot light burner. The separate combustion air inlet port supplies the primary air to the pilot burner and is located on the side wall of the burner housing between the main combustion air inlet port and the combustion chamber. Another object is to provide an arrangement of a pilot light burner system which enables easy mounting with features of adjustment to enable reliable usage. Another object is to provide a pilot light burner tip means having a heat sink and air current shield protection against flame blowout while also providing for automatic reignition of the pilot flame after flame blowout.

In general, the invention comprises an elongated generally cylindrical tubular housing means with a combustion air inlet at one end and an exhaust stack at the other end. The housing means provides an elongated combustion air chamber adjacent the air inlet end and an elongated combustion chamber adjacent the stack end. A main gas burner unit is mounted in the housing means adjacent and parallel to the central longitudinal axis thereof with gas inlet means extending radially inwardly through the side wall of the combustion air chamber to an air-gas mixing means located in the combustion air chamber. A venturi means extends from the air gas mixing means into the combustion chamber toward the stack end and is connected by an elongated air-gas passage tube means to an ignition tip means located in the combustion chamber. A pilot light burner unit is mounted in the housing means adjacent and in parallel relationship with the main burner unit. A separate pilot gas inlet means and a separate pilot primary air inlet means extend radially inwardly through the side wall of the combustion air chamber to an air-gas mixing chamber means, including an adjustable gas nozzle discharge device, which is closed relative to the main burner combustion air chamber. An adjustable elongated first pilot air-gas mixture supply tube means, including an air-gas mixing chamber and venturi means associated with the gas nozzle discharge device, extends from pilot air-gas mixing chamber means into the combustion chamber and is connected to another pilot air-gas supply tube means having an ignition tip means mounted on the end thereof adjacent the main burner ignition tip means. The ignition tip means has a sleeve means circumjacent a burner means to provide a heat sink for reignition of the pilot flame and to protect against flame out due to air currents.

BRIEF DESCRIPTION OF DRAWING

An illustrative and presently preferred embodiment of the invention is shown in the accompanying drawing wherein.

DETAILED DESCRIPTION

Figure 2:
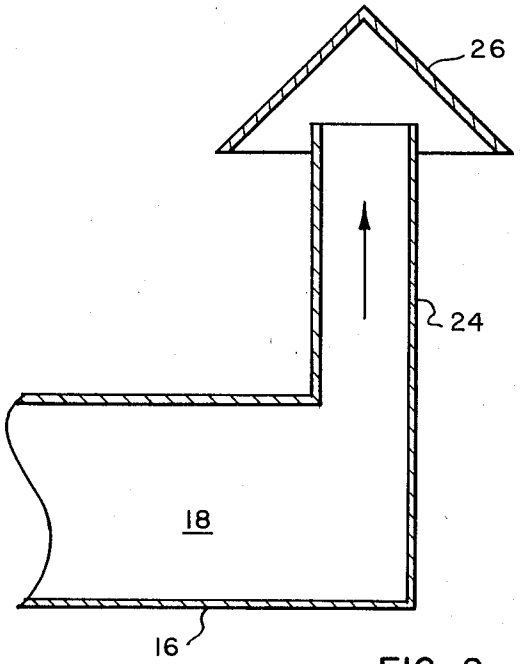
FIG. 2 is a reduced schematic cross-sectional view of the stack end portion of the burner housing of FIG. 1.

In general, the illustrative and presently preferred form of the burner unit 10 of the invention comprises a cylindrical elongated air supply housing means 12 of relatively large diameter which provides an air supply chamber 14 and a cylindrical elongated combustion housing means 16 of relatively small diameter which provides a combustion chamber 18. Housing means 12 and 16 are mounted on opposite sides of support plate means 19 having a central opening 20. A flame arrestor means 21 is mounted at one end of housing means 12 opposite the combustion chamber 18. An exhaust stack means 24, FIG. 2, having a shield means 26 is mounted at the other end of housing means 16 and connected to the combustion chamber 18.

A main burner means 28 is centrally mounted in housing means 12 and 16 with a combustion tip means 30 at the end thereof located in combustion chamber 18. Main burner means 28 comprises a gas inlet pipe means 34 and a coupling means 36 which support a gas nozzle means 38, FIG. 6, a venturi means 40 and an elongated gas-air mixture supply pipe means 42. Gas inlet means 34 comprise a radially inwardly extending pipe portion 43, mounted on a suitable coupling device 44 in the side wall 45 of housing means 12, which is connected to a regulated source of supply gas 46 through a thermostatically controlled throttle valve means 48 which maintains a gas pressure of, for example, 2 to 18 psig.

A pilot light burner means 50 is centrally mounted in housing means 12 and 16 in parallel juxtaposition to main burner means 28 and comprises an air chamber housing means 52 mounted on an air inlet pipe means 54, a venturi means 56, a constant diameter air-gas mixture supply pipe means 58, and a pilot burner ignition tip means 60 located adjacent main burner ignition tip means 30. Pilot light burner 50 is connected to a supply of regulated natural gas 64 through gas inlet conduit means 61 extending radially outwardly to a coupling means 62 in the side wall of housing means 12. Pilot light air inlet means 54 is mounted on a coupling means 66 in the side wall of housing means 12 and connected to an air inlet port means 68 on the end of air inlet passage means 70. A flame arrestor means 74 is mounted on port means 68.

Figure 3:
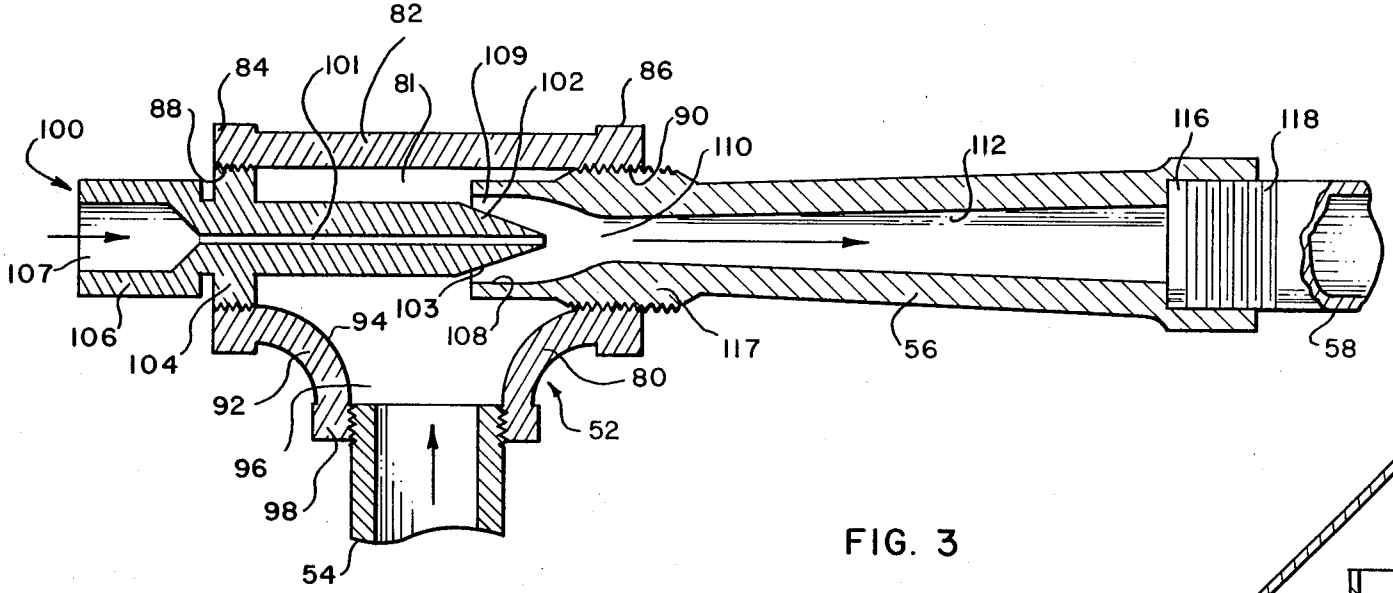
FIG. 3 is an enlarged cross-sectional side elevational view of the air-gas inlet end portion of the pilot light unit of FIG. 1.

Referring now to FIG. 3, air chamber housing means 52 comprises a T-shape pipe coupling type member 80 which defines an air chamber 81. Member 80 has a generally cylindrical horizontally extending main body portion 82 with end portions 84, 86 surrounding threaded openings 88, 90. A radially outwardly extending central portion 92, having a rounded wall portion 94, defines a passage 96 of variable diameter cylindrical cross-sectional configuration and terminates in a threaded end portion 98. An adjustable threaded elongate nozzle means 100 has a central gas passage 101 extending through a conical tip portion 102 with a conical peripheral surface 103, a central threaded portion 104 threadably mounted in and supported in opening 88, and an adjustment coupling head portion 106 with a coupling socket 107 for receiving gas conduit means 61. Conical tip portion 102 is located in a cylindrical chamber 108 in the end of venturi means 56 to define a variable size orifice 109 therebetween. The diameter of chamber 108 is gradually reduced to provide a venturi type section 110 which is connected to an elongated passage 112 of gradually increasing variable diameter cross-sectional configuration terminating at an enlarged threaded opening 116 at the burner tip end. A threaded end portion 117 of member 56 is adjustably threadably received in opening 90 in member 52. Adjustment of the axial location of tip 102 in cylindrical chamber 108 may be accomplished by thread connections 88 or 90. The end 118 of pipe 58 is threadably received in opening 116. Conical point 102 is centered on and located in chamber 108 to provide variably adjustable orifice means to regulate the flow of air from chamber 81 into venturi section 110.

Figure 1:
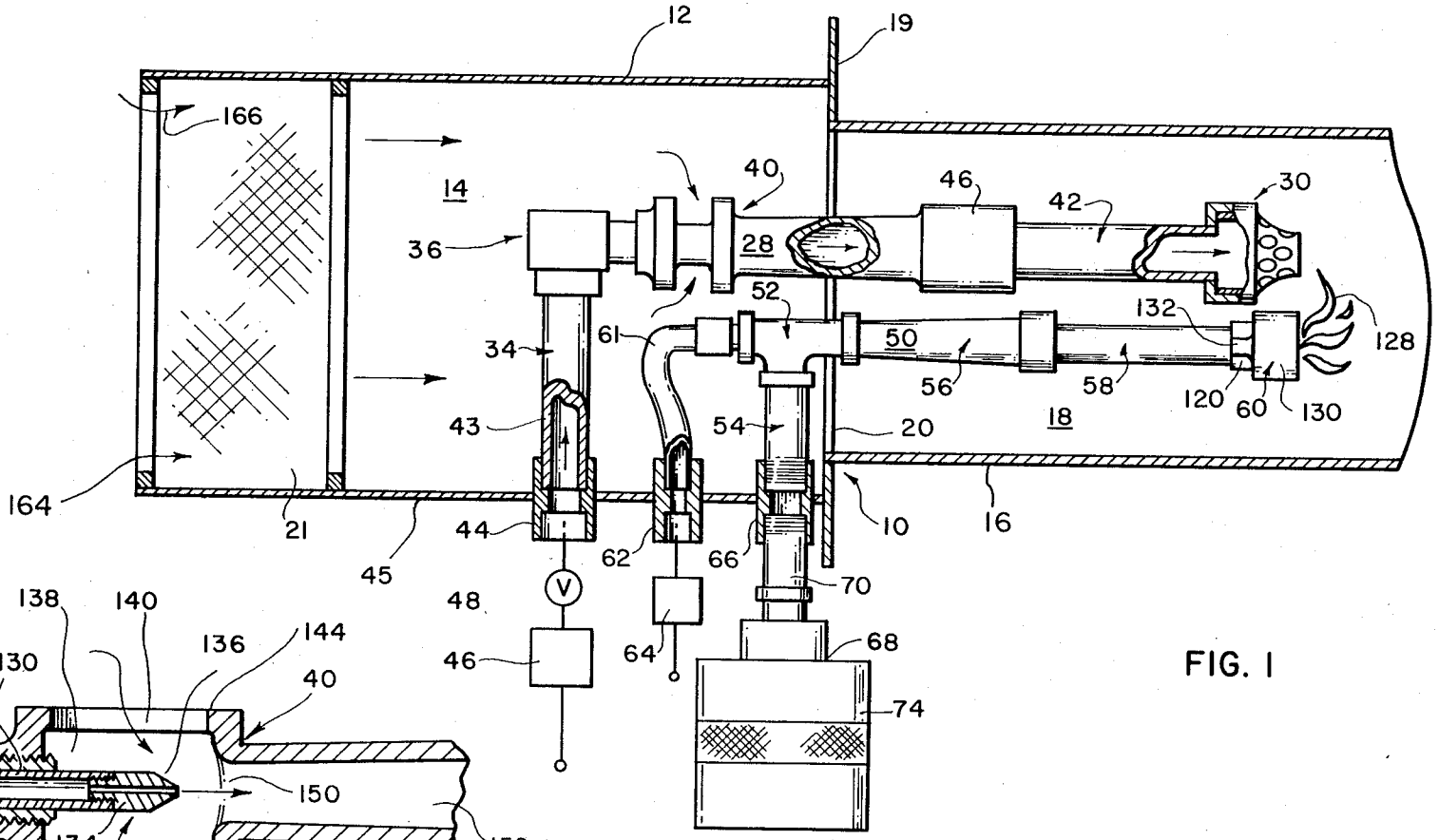
FIG. 1 is a schematic cross-sectional side elevational view with parts removed of a portion of burner housing with a main burner unit and a pilot light unit mounted therein.
Figure 5:
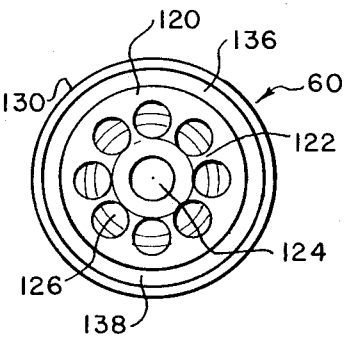
FIG. 5 is an end view of the ignition tip portion of the pilot light unit.
Figure 4:
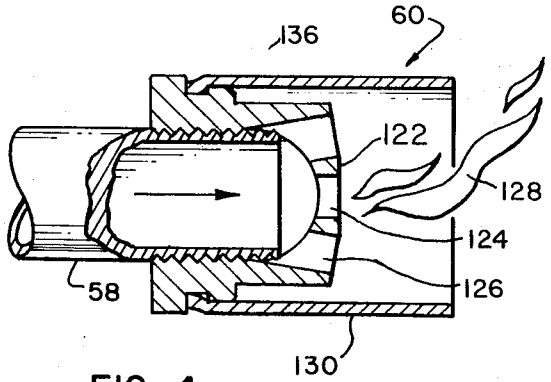
FIG. 4 is an enlarged cross-sectional view of the ignition tip end portion of the pilot light unit.

As shown in detail in FIGS. 4 and 5, pilot burner tip means 60 comprises a machined member 120 threadably mounted on the end of pipe section 58. An end portion 122 has a central circular 123 coaxial with pipe 58 opening and a plurality of circumferential spaced inclined openings 125 whereat the air-gas mixture is discharged and ignited to produce a pilot flame 126 adjacent main burner ignition tip 30. An annular stainless steel sleeve member 127 is fixedly sealably mounted on member 120 by crimping into slots 128, 129 on member 120. Provide a flame impingement area 130 for the flame from holes 125 to heat sleeve 127. In addition, member 127 has a length such as to extend a substantial distance in front of end plate portion 122 to protect the pilot flame against blowout due to air currents while also being heated thereby to provide a heat sink capable of re-igniting the pilot flame in the event of pilot flame blow-out. In addition, the heat sink sleeve is located adjacent the main burner flame ports for heating thereby as shown in FIG. 1.

Figure 6:
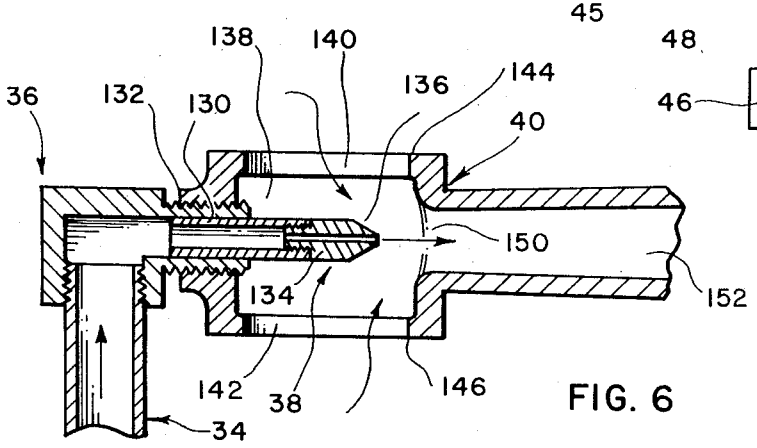
FIG. 6 is an enlarged cross-sectional view of the air-gas inlet portion of the main burner unit of FIG. 1.

As shown in FIG. 6, main burner nozzle means 38 comprises a sleeve portion 131 mounted in a threaded coupling portion 132 of coupling means 36 and a tip portion 134 having a conical end surface 136 located in an air chamber 138 connected to the combustion air chamber 14 in housing means 12 through semi-cylindrical air passages 140, 142 separated by connecting rib portions 144, 146. A venturi-type air-gas passage section 150 is located opposite gas nozzle tip 134. An elongated tapered passage 152 of gradually increasing diameter extends away fromm section 150.

In operation of the pilot burner means, atmospheric air is constantly delivered to chamber 81 in coupling member 52 through flame arrestor means 74, coupling 68, pipe 70, coupling 66 and pipe 54. Gas, at relatively low pressure (e.g., 2 to 10 psi), is delivered to relatively small diameter nozzle passage 101 through gas pressure regulator 64, coupling 62, and line 61. The gas is discharged into chamber 108 toward venturi throat section 110 and mixed with air drawn by the venturi vacuum from chamber 81 through orifice 109 between conical tip portion 102 and the end of pipe section 56. Air and gas flow through venturi throat section 110 into tapered passage 112 and then into pipe 58 to be discharged through openings 123, 125 in pilot burner end plate 122. When the pilot air-gas mixture is ignited by suitable means (not shown), a pilot light flame 126 is maintained adjacent main burner tip 30 as illustrated in FIG. 1. The burner light flame is protected by annular member 127 which also serves as a heat sink to maintain ignition of the pilot light air-gas mixture. Whenever gas is supplied on demand to main gas burner 30 through regulator means 46 and thermostatically controlled throttle valve means 48, pilot light flame 128 will cause ignition thereof.

While an illustrative and presently preferred embodiment of the invention has been described hereinbefore, it is contemplated that the inventive concepts may be otherwise variously embodied. For example, the pilot light combustion air and gas inlet means may be otherwise located. The gas supply may be natural gas, propane gas or any other suitable kind of gas. Also, the housing means may be of polygonal or other cross-sectional configuration. This, it is intended that the claims appended hereto be construed to include alternative embodiments except insofar as limited by the prior art.

What is claimed is:

1. A gas heating system for oil and gas processing equipment or the like comprising:

a main gas burner means for supplying heat to the oil and gas processing equipment;

a pilot light burner means mounted in juxtaposition to said main gas burner means for continuously providing a flame for ignition of said main gas burner means;

a housing means for enclosing said main gas burner means and said pilot light burner means therewith;

a main burner air-gas supply means at one end of said housing means for supplying combustion air and gas to said main gas burner means;

a combustion chamber means at the opposite end of said housing means for burning an air-gas mixture therewithin:

stack means connected to said combustion chamber means for receiving products of combustion therefrom;

pilot primary air-gas supply means separate from said main burner air-gas supply means and being connected only to said pilot light burner means for supplying pilot light primary combustion air and gas only to said pilot light burner means separately and independently of said main burner air-gas supply means;

means for automatically reigniting said air-gas issuing from said pilot light burner means in the event said flame should be extinguished comprising:

a pilot burner ignition tip means mounted on the end of said air-gas mixture passage means for continuously burning the air-gas mixture and maintaining a pilot flame adjacent said main gas burner means; and a sleeve means mounted circumjacent said pilot burner ignition tip means for protecting said pilot flame and for serving as a heat sink means for receiving and storing sufficient heat during operation of said pilot burner means to reignite said pilot burner means in the event of flame blowout.

2. The invention as defined in claim 1 and wherein said housing means being of elongated tubular construction.

3. The invention as defined in claim 2 and wherein said pilot light burner means comprising:

a housing means having air chamber means connected to said pilot air supply means for receiving pilot light combustion air;

a pilot gas nozzle means threadably adjustably mounted in said housing means for receiving pilot light supply gas; and an air-gas mixing means threadably adjustably connected to said housing means opposite said pilot gas nozzle means for receiving and mixing pilot gas from said nozzle means and air from said air chamber means and for enabling flow of a pilot air-gas mixture to said pilot light burner means.

4. A gas heating system for oil and gas processing equipment or the like comprising:

a main gas burner means for supplying heat to the oil and gas processing equipment;

a pilot light burner means mounted in juxtaposition to said main gas burner means for continuously providing a flame for ignition of said main gas burner means;

an elongated tubular outer main housing means for enclosing said main gas burner means and said pilot light burner means therewith;

a main burner air-gas supply means at one end of said outer main housing means for supplying combustion air and gas to said main gas burner means;

a combustion chamber means at the opposite end of said outer main housing means for burning an air-gas mixture therewithin;

stack means connected to said combustion chamber means for receiving products of combustion therefrom;

pilot primary air-gas supply means separate from said main burner air-gas supply means and being connected only to said pilot light burner means for supplying pilot light primary combustion air and gas only to said pilot light burner means separately and independently of said main burner air-gas supply means;

a combustion tip means on said pilot light burner means including a heat sink shield means for receiving and storing sufficient heat during operation of said pilot light burner means to reignite said pilot burner means in the event of flame blowout;

an inner pilot housing means having air chamber means connected to a pilot primary air supply means for receiving pilot light combustion air;

a pilot gas nozzle means threadably adjustably mounted in said pilot housing means for receiving pilot light supply gas;

an air-gas mixing means threadably adjustably connected to said pilot housing means opposite said pilot gas nozzle means for receiving and mixing pilot gas from said nozzle means and air from said air chamber means and for enabling flow of a pilot air-gas mixture to said pilot light burner means;

an air-gas mixing chamber at the end of said air-gas mixing means located opposite and circumjacent said pilot gas nozzle means for receiving pilot air and pilot gas;

a venturi-type air passage means between said pilot gas nozzle means and said air-gas mixing means for enabling flow of pilot air into said air-gas mixing chamber; and an air-gas mixture venturi means located opposite said pilot gas nozzle means and downstream of said air-gas mixing chamber for connecting said chamber to said combustion means.

5. A gas heating system for oil and gas processing equipment or the like comprising:

a main gas burner means for supplying heat to the oil and gas processing equipment;

a pilot light burner means mounted in juxtaposition to said main gas burner means for continuously providing a flame for ignition of said main gas burner means;

an outer main housing means for enclosing said main gas burner means and said pilot light burner means therewith;

a main burner air-gas supply means at one end of said main housing means for supplying combustion air and gas to said main gas burner means;

a combustion chamber means at the opposite end of said main housing means for burning an air-gas mixture therewithin;

stack means connected to said combustion chamber means for receiving products of combustion therefrom;

pilot primary air-gas supply means separate from said main burner air-gas supply means and being connected only to said pilot light burner means for supplying pilot light primary combustion air and gas only to said pilot light burner means separately and independently of said main burner air-gas supply means;

a pilot burner ignition tip means for continuously burning an air-gas mixture and maintaining a pilot flame adjacent said main gas burner means;

a sleeve means mounted circumjacent said pilot burner ignition tip means for protecting and enabling reignition of the pilot flame;

a main gas burner combustion tip means mounted in said combuston chamber means for burning an air-gas mixture;

a gas supply pipe means extending into said main housing means for providing a supply of fuel gas to said main gas burner combustion tip means;

a coupling means mounted on said gas supply pipe means adjacent the central longitudinal axis of said main housing means for connecting said gas supply pipe means to said main gas burner combustion tip means;

a gas nozzle means mounted in said coupling means and extending toward said combustion chamber means for discharging gas from said coupling means;

an elongated air-gas mixing pipe means mounted on said coupling means and extending toward said combustion chamber means for supplying an air-gas mixture to said main gas burner combustion tip means and having a gas inlet end portion connected to said coupling means, an air-gas mixing chamber surrounding said nozzle means, a venturi passage section opposite said nozzle means, an elongated passage portion of gradually increasing diameter next adjacent said venturi section, and a gas-air mixture outlet end portion including a coupling device; and said main gas burner combustion tip means being mounted on said coupling device on said air-gas outlet end portion of said air-gas mixture supply pipe means for discharging the air-gas mixture into said combustion chamber and maintaining ignition of the air-gas mixture therein.

6. A gas heating system for oil and gas processing equipment or the like comprising:

a main gas burner means for supplying heat to the oil and gas processing equipment;

a pilot light burner means mounted in juxtaposition to said main gas burner means for continuously providing a flame for ignition of said main gas burner means;

a main housing means for enclosing said main gas burner means and said pilot light burner means therewith;

a main burner air-gas supply means at one end of said main housing means for supplying combustion air and gas to said main gas burner means;

a combustion chamber means at the opposite end of said main housing means for burning an air-gas mixture therewithin;

stack means connected to said combustion chamber means for receiving products of combustion therefrom;

pilot primary air-gas supply means separate from said main burner air-gas supply means and being connected only to said pilot light burner means for supplying pilot light primary combustion air and gas only to said pilot light burner means separately and independently of said main burner air-gas supply means;

a pilot light burner combustion tip means mounted in said combustion chamber means adjacent said main burner means for igniting said main burner air-gas mixture;

a pilot air supply pipe means extending into said main housing means for providing a closed separate supply of air to said pilot light burner combustion tip means;

a pilot air coupling means mounted on said air supply pipe means adjacent the central longitudinal axis of said main housing means for connecting said pilot air supply pipe means to said pilot light gas burner means; and having a pilot air chamber, a first coupling device at one end of said air chamber, and a second coupling device at the opposite end of said air chamber and a third intermediate coupling device connected to said air supply pipe means;

a pilot gas nozzle means axially adjustably mounted in said first coupling device for discharging gas and having a coupling end portion for connection to a supply of pilot gas and adjustable connection to said first coupling device, an enlongated gas passage of relatively small diameter terminating in a gas discharge opening opposite said second coupling device, and a conical tapered outer end portion opposite said second coupling device;

a pilot gas supply tube means extending into said housing means for providing a supply of gas to said pilot light burner means, and for connection to said coupling end portion on said pilot gas nozzle means;

an elongated air-gas mixing pipe means mounted on said coupling means and extending towards said combustion chamber means for supplying an air-gas mixture to said pilot light burner combustion tip means; and having an adjustable coupling device connected to said second coupling device on said coupling means for enabling axial adjustment of said air-gas mixing pipe means relative to said coupling means, an end portion extending into said air chamber means toward said gas nozzle means a cylindrical air-gas mixing chamber in said end portion coaxial with and of larger diameter than said gas nozzle means and positioned circumjacent said conical tapered end portion to define a variable size annular orifice therebetween for controlling flow of air into said cylindrical air-gas mixing chamber from said air chamber means to form an air-gas mixture therewithin, a venturi passage section next adjacent said cylindrical air-gas mixing chamber for receiving the air-gas mixture from said cylindrical air-gas mixing chamber, an enlongated passage portion of gradually increasing diameter next adjacent said venturi passage section for receiving the air-gas mixture from said venturi passage section, and an air-gas mixture outlet end portion including a fourth coupling device at the end of said elongated passage portion;

an elongated air-gas supply pipe means mounted on said fourth coupling device on said air-gas mixing pipe means and extending into said combustion chamber for supplying the air-gas mixture to said pilot light burner combustion tip means; and having an air-gas mixture inlet end portion connected to said fourth coupling device on said air-gas outlet end portion of said air-gas mixing pipe means, an elongated passage portion of constant diameter, and an air-gas outlet end portion including a fifth coupling device; and said pilot light burner combustion tip means being mounted on said fifth coupling device on said air-gas outlet end portion of said air-gas mixture supply pipe means for discharging the air-gas mixture therein having a sleeve means mounted in adjacent reignition of the pilot thereto for contact with the pilot flame for causing air-gas mixture pilot light flame blowout.

7. The invention as defined in claim 6 and wherein said pilot light burner combustion tip means comprising:

an end plate having a plurality of circumferential spaced air-gas mixture discharge ports; and a cylindrical sleeve mounted circumjacent spaced relationship to said end plate to provide secondary air passage means therebetween and a heat sink means for maintaining ignition.

* * * * *